US005687652A

United States Patent [19]

Ruma

[11] Patent Number: 5,687,652

[45] Date of Patent: Nov. 18, 1997

[54] ORIENTED FIBER REINFORCED MONOLITHIC PLASTIC FOAM PALLET

[76] Inventor: Joseph G. Ruma, 1004 Bluebonnet Dr., Sunnyvale, Calif. 94086

[21] Appl. No.: 394,795

[22] Filed: Feb. 27, 1995

Related U.S. Application Data

[63] Continuation-in-part of Ser. No. 083,360, Jun. 28, 1993, abandoned.

[51] Int. Cl.[6] ..... B65D 19/00

[52] U.S. Cl. ..... 108/561; 108/901

[58] Field of Search ..... 108/901, 902, 108/51.1, 56.1

[56] References Cited

U.S. PATENT DOCUMENTS

| | | | |
|---|---|---|---|
| 3,511,191 | 5/1970 | Barry, Jr. et al. | 108/901 X |
| 3,581,681 | 6/1971 | Newton | 108/901 X |
| 3,710,157 | 1/1973 | Arcocha et al. | 108/901 X |
| 3,717,922 | 2/1973 | Witkowski | 108/901 X |
| 3,757,704 | 9/1973 | Allgeyer et al. | 108/901 X |
| 3,814,778 | 6/1974 | Hosoda et al. | 108/901 X |
| 4,103,857 | 8/1978 | Levenhagen | 108/901 X |
| 4,397,246 | 8/1983 | Ishida et al. | 108/901 X |
| 5,080,960 | 1/1992 | Smorada | 108/901 X |
| 5,123,359 | 6/1992 | DelBalso | 108/901 X |
| 5,349,749 | 9/1994 | Fiedler | 108/901 X |

*Primary Examiner*—Jose V. Chen

*Attorney, Agent, or Firm*—James J. Leary; Leary, Titus & Aiello

[57] ABSTRACT

A new and improved unitary plastic foam four-way entry pallet (10) comprising: a top deck (11), with perforated apertures (12), buttressed by a plurality of elongated support runners (13) which are profiled to receive material handling equipment; the runners are joined to a plurality of bottom members (14), perpendicular to the plane of the support runners. All the components are monolithically cast, in a mold, utilizing rigid plastic foam reinforced with oriented strand fibers to form homogenous matrix (16), which has a seamless, smooth finish (15), provided by the use of self-skinning foams.

30 Claims, 6 Drawing Sheets

MIXING AND INJECTION INTO MOLD

FLOW CHART OF OPERATIONS

NUMBER OF MOLDS EQUAL CURING TIME DIVIDED BY FILLING CYCLE TIME ACHIEVING ONE COMPLETED PALLET PER EACH FILL CYCLE OPERATION

ORIENTED FIBER REINFORCED MONOLITHIC PLASTIC FOAM PALLET

RELATIONSHIP TO OTHER APPLICATIONS

This patent application is a continuation-in-part of patent application, Ser. No. 08/083,360, filed Jun. 28, 1993, now abandoned, the specification of which is hereby incorporated by reference in its entirety.

FIELD OF THE INVENTION

The invention relates to pallets, and specifically to an improved unitary plastic foam pallet with four-way entry by material handling equipment.

BACKGROUND OF THE INVENTION

Pallets for the unitizing of articles for shipping and storage have been in commerce many years. The most common in use is the wooden pallet consisting of a series of slats resting on runners, notched at their sides to achieve entry from four directions, and usually including bottom boards for extra rigidity. These components are commonly fastened together with nails. The wood used in these pallets is often not kiln dried. Because of rough usage, and the shrinking of the wood in drying with age, the nails become loose; this often causes damage to the cargo, loss of rigidity and often collapse of the pallet. Wooden pallets often cause wound injuries because of splinters, and back injuries because of their weight. Even with repairs, wooden pallets eventually must be disposed of when their useful life is over. The disposal cost at a landfill often approaches the original cost of the pallet. Because wooden pallets cannot be sterilized against bacteria and fungus infestation easily, they cannot be used for the transport of certain commodities.

Plastic pallets overcome many of the deficiencies of wood; however they must often be reinforced for the necessary load capacities, or of such weight as to reduce their practicality. There have been many ways to approach this problem. Many, such as U.S. Pat. No. 3,719,157, to Arcocha et al., and U.S. Pat. No. 5,050,506, to Fiedler, have encapsulated plastic foam within rigid shells. Others, such as U.S. Pat. No. 3,861,326, to Brown, have used a rigid plastic foam sandwiching a corrugated fiberboard. Fiedler, U.S. Pat. No. 5,042,397, incorporates a corrugated fiberglass sheet material within each component comprising the pallet. In all of the above patents, the components must be fastened together with adhesives or bonding to complete the manufacture of the pallet. Cerugeira, U.S. Pat. No. 4,966,083, laminates several different materials, including metallic wiring, rubber, and curable material in a single block, which is then hot molded or pressed.

SUMMARY OF THE INVENTION

This invention is a monolithically cast pallet of unitary construction, wherein the components of the platform, runners and bottom members are formed in a single mold at the same time. Four-way entry is incorporated into the design to facilitate the use of material handling equipment. Plastic foam and oriented strand fibers are injected into the mold simultaneously. The result is a complete pallet, which eliminates the necessity of further assembly of the components, fastening the components with adhesives or bonding, or other finishing operations. While others have claimed monolithic assembly of components, in reality, their systems depend on prior or further assembly of components to achieve a so-called composite monolithic construction. This invention is one that produces a completely finished product in one casting operation and is truly monolithic. The invention achieves the goals of lightness and strength in a novel and simpler manner than any prior art pallet construction. Its uniqueness is its monolithic casting process.

The unitary pallet, using reaction injection molding plastic foams, such as polyurethane, or other plastic foams which do not use chemical means to achieve froth, results in a closed cell, self skinned product that does not require surface treatment to inhibit the penetration of moisture, solvents and microorganisms. It can be easily sterilized and is free of voids or crevices in which bacteria or fungi might proliferate.

By adjusting the density of the foam and the amount and type of reinforcement in the matrix, pallets of various weight holding capacity and lightness can be achieved. This accommodates air freight shippers on one hand and closed loop shippers on the other, where one requires a lightweight one-way pallet and the other a more durable one, having the capacity to carry heavy loads.

The support members at the bottom of the pallet add load-bearing capabilities by distributing the weight and are a desired feature of volume users, such as bottlers, who must pass their pallets on a conveyor system to unitize loads, warehouse users, such as wholesale grocers, whose loaded pallets must be placed on pallet racks, and shippers of products, such as rolled roofing material, who desire to stack loads without the use of bottom sheets.

Further, an added feature is the aspect of recycleability. Rejected assemblies and returned pallets from users can be ground up and used in the manufacture of new pallets. This can be as an additive granular ingredient, if the recycled pallet is of thermoset plastic materials, or as a plastic ingredient, in the case of thermoplastic materials.

DETAILED DESCRIPTION OF THE INVENTION

Figure 1:
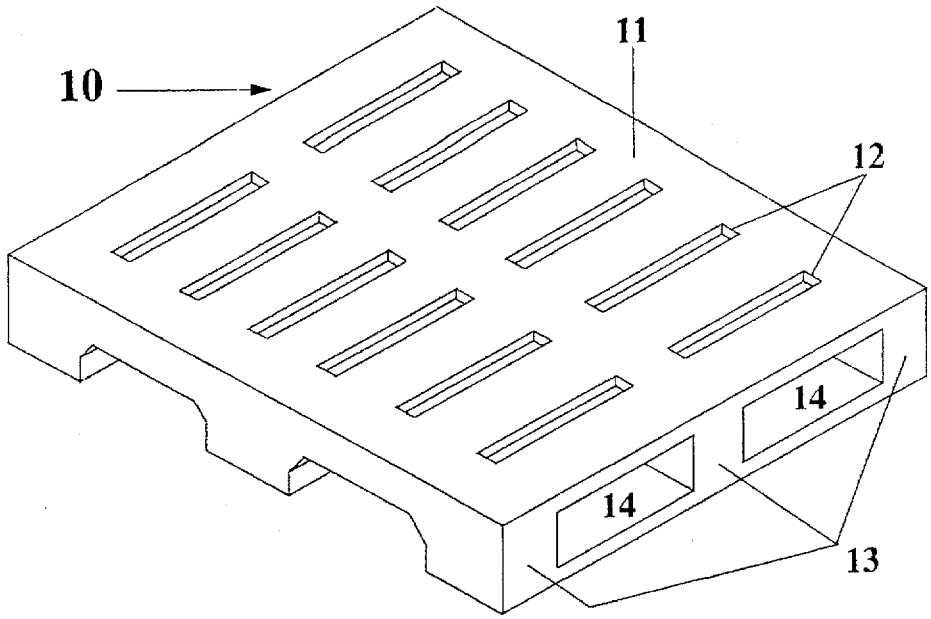
FIG. 1 is an isometric view of the monolithic pallet as seen from above.
Figure 2:
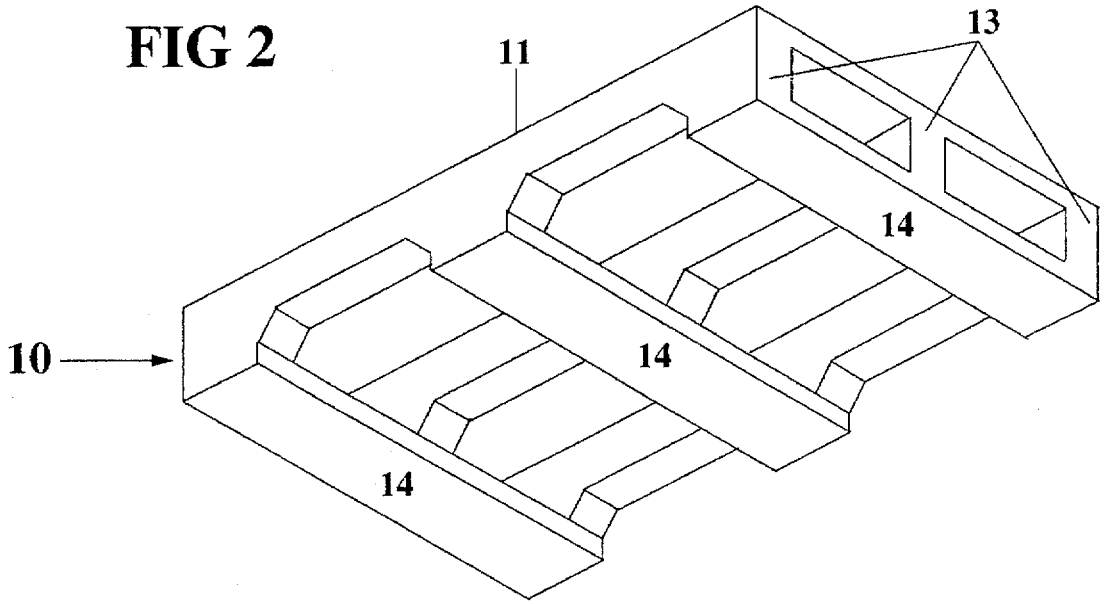
FIG. 2 is an isometric view of the pallet in FIG. 1 as viewed from below.

FIG. 1 shows a pallet 10 having a top deck 11 which is perforated with openings 12 for weight reduction and passage of air. The pallet deck is buttressed by elongated runners 13, these runners 13 are formed integrally with the top deck 11 and create walls. The runners 13 are notched to allow a fork lift to enter perpendicular to the runner 13. The bottom of the runners 13 are joined to bottom supports 14 which run perpendicular to the runners 13. FIG. 2 shows a bottom view of the pallet of FIG. 1 showing the bottom supports 14. The perforated openings have been eliminated from the upper deck in this view for clarity.

Figure 3:
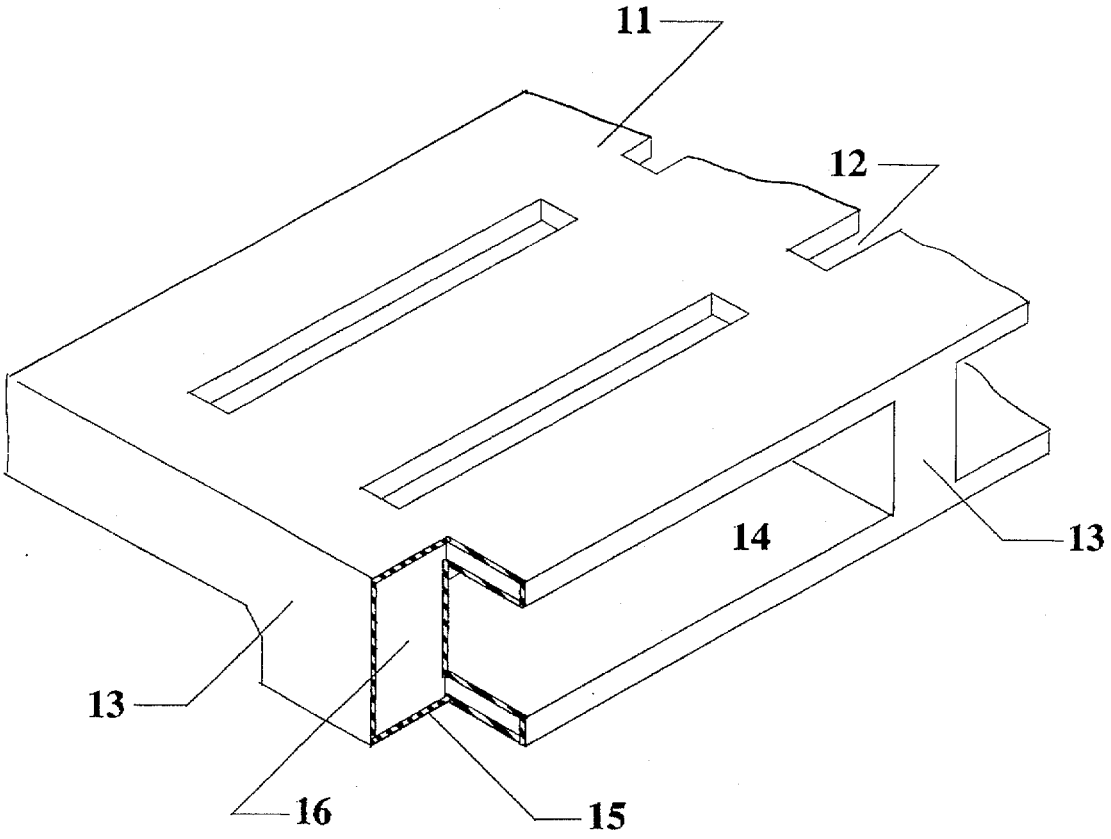
FIG. 3 is a cut away corner section of a portion of the pallet in FIG. 1.

FIG. 3 is a cutaway portion of a pallet showing the monolithic properties of the pallet, which are achieved without further fastening by mechanical or adhesive means. The elongated runners are of such dimension and are profiled in the mold, to receive the prongs of a forklift truck, pallet jack or other material handling equipment. The pallet is monolithically formed by casting or reaction injection molding plastic foam and oriented strand fibers simultaneously in a mold, under pressure, producing a homogenous matrix of uniform density and strength 16. The mold is constructed to achieve the triaxial openings to allow 4-way entry into the finished pallet, weight reduction, and air passage apertures in the pallet deck. The use of self-skinning plastic foams produces a smooth, seamless exterior surface 15 on all parts of the pallet in contact with the mold. The matrix can be easily adjusted for varying weight carrying capacities of the pallet by adjusting the density of the plastic foam and/or the quantity injected by the dispensing equipment, at the injection site and by adjusting the amount and the length of the oriented strand fibers included in the mixture.

Figure 4:
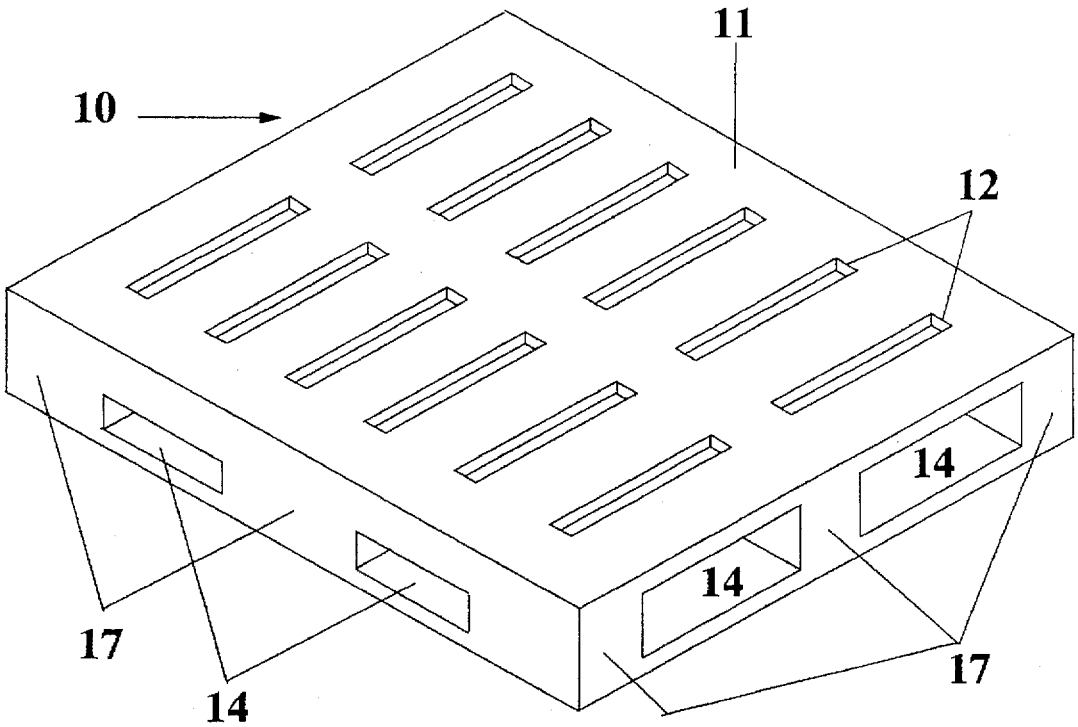
FIG. 4 is an isometric view of an alternative construction of the pallet.

FIG. 4 is an isometric view of an alternative construction of the pallet. Upright pillars or legs 17 are used rather than elongated runners to support the upper deck. These legs 17 are located such that the openings (the same as the notches in the runners 13) for the fork lift are still present. The bottom supports 14 would interconnect all pillars.

Figure 5:
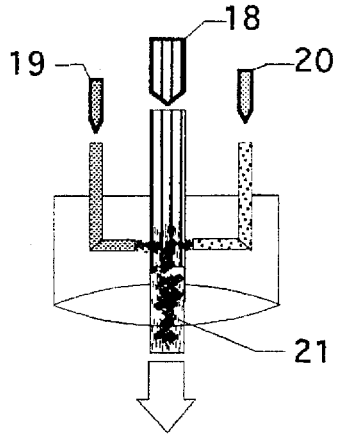
FIG. 5 is a schematic diagram of reinforcing fibers being oriented and impregnated with plastic foam prior to injection into the mold.

FIG. 5 is a schematic view of oriented fibers 18 oriented along their long axes by introduction into an enclosed airstream. Components that form rigid structural plastic foam, 19 and 20 are mixed by impingement and combined with the oriented fibers 18 to form a mixture 21 just prior to injection into a mold which forms the self-skinning outer skin 15 and matrix 16 of the monolithic pallet 10.

Figure 6:
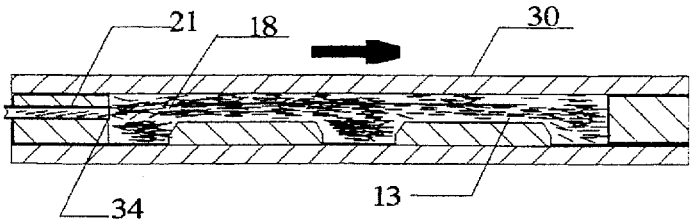
FIG. 6 is a schematic diagram of the mold, showing fiber orientation along the runner axes.

FIG. 6 is a schematic of the plastic foam impregnated mixture 2 1 entering a gate valve of the mold to align the oriented fibers 18 along the long axes of the pallet runners 13.

Figure 7:
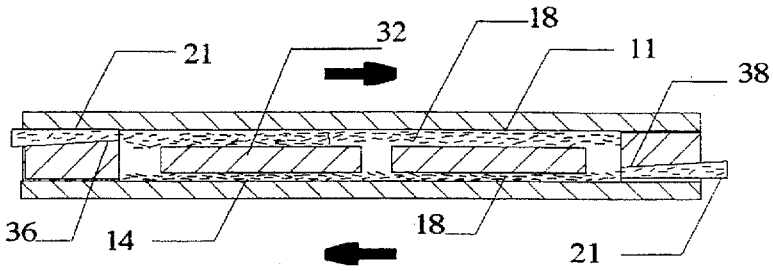
FIG. 7 is a schematic diagram of the mold showing fiber orientation along the top platform and bottom supports axes.

FIG. 7 is a schematic of the plastic foam impregnated mixture 2 1 entering gate valves of the mold to align the oriented fibers 18 along the long axes of the top platform 11 and bottom supports 14. The gate valves are located at opposing ends of the mold and are perpendicular to the flow of the mixture 21 as shown in FIG. 6.

Reaction Injection Molding, with the acronym, RIM, process involves the high-pressure impingement mixing of two or more reactive liquid components and injection of the mixture into a closed mold at low pressures. The process is also called Liquid Injection Molding, High Pressure Impingement Molding and Reaction Liquid Impingement Molding, with the acronyms, LIM and RLIM. In this process, the two components of a resin such as urethane or other polymer are metered carefully and mixed at a very high pressure in a mixing chamber prior to injection into the mold where fast thermoset cure is achieved. Large and thick parts can be molded using fast cycles with relatively low-cost materials. Its low energy requirements with relatively low investment costs make RIM attractive. The low cost of RIM molding machines is the result of the low pressures that are used.

When chopped-glass-fiber-reinforcement is added to the mixture, high values of modulus of elasticity and heat resistance are achieved. RIM generally delivers faster cycles than other processes with its high-pressure dispensing equipment to handle fast-acting resin systems.

Reactive foams, such as polyurethane, in varying density formulation, are available worldwide from many chemical manufacturers. The equipment to dispense these chemicals is also widespread. Such equipment also has the capacity to include the dispensing of other desirous elements of the pallet composition, such as fire retardants, blowing agents, colorants and catalysts. This invention's conception is that such additives are not to be precluded from its patent. Nor is the scope of the invention limited to the use of plastic foams that are reactive solely by chemical means, but rather to include other plastics which may obtain their foaming properties by other means, such as inclusion of inert gases.

The oriented strands, included for reinforcement, are also readily available. While the invention lends itself to the use of oriented glass filaments, commonly known as fiberglass, and sold by many manufacturers, such as Owens-Corning, it does not preclude the use of other organic and nonorganic fibers. Other fibers that could be used for reinforcing the pallet construction include, but are not limited to, Kevlar fibers, carbon fibers, polyester fibers, cellulose fibers, ceramic fibers, or metal fibers. The reinforcing fibers can be added as short chopped strands of 0.10–0.25 inches or long strands of 0.75–1.00 inches to the plastic matrix material in the foamed or unfoamed condition, depending on the mixing and molding processes utilized; however, by orienting the fibers in a unidirectional path along the long axes of the various components greater strength is achieved. The longer fiber strands provide additional overlap between the oriented fiber strands within the foamed plastic matrix, lending greater strength and rigidity to the molded pallet.

As shown in FIG. 6 and FIG. 7, the mold 30 into which the blended plastic foam and oriented fiber strands 21 is injected is a clam-shell design mold with removable cores 32 for maintaining the open spaces between the top platform 11, the bottom supports 14 and the runners 13 of the pallet. The mold is suitable for reaction injection molding or monolithic casting of the pallet.

Figure 8:
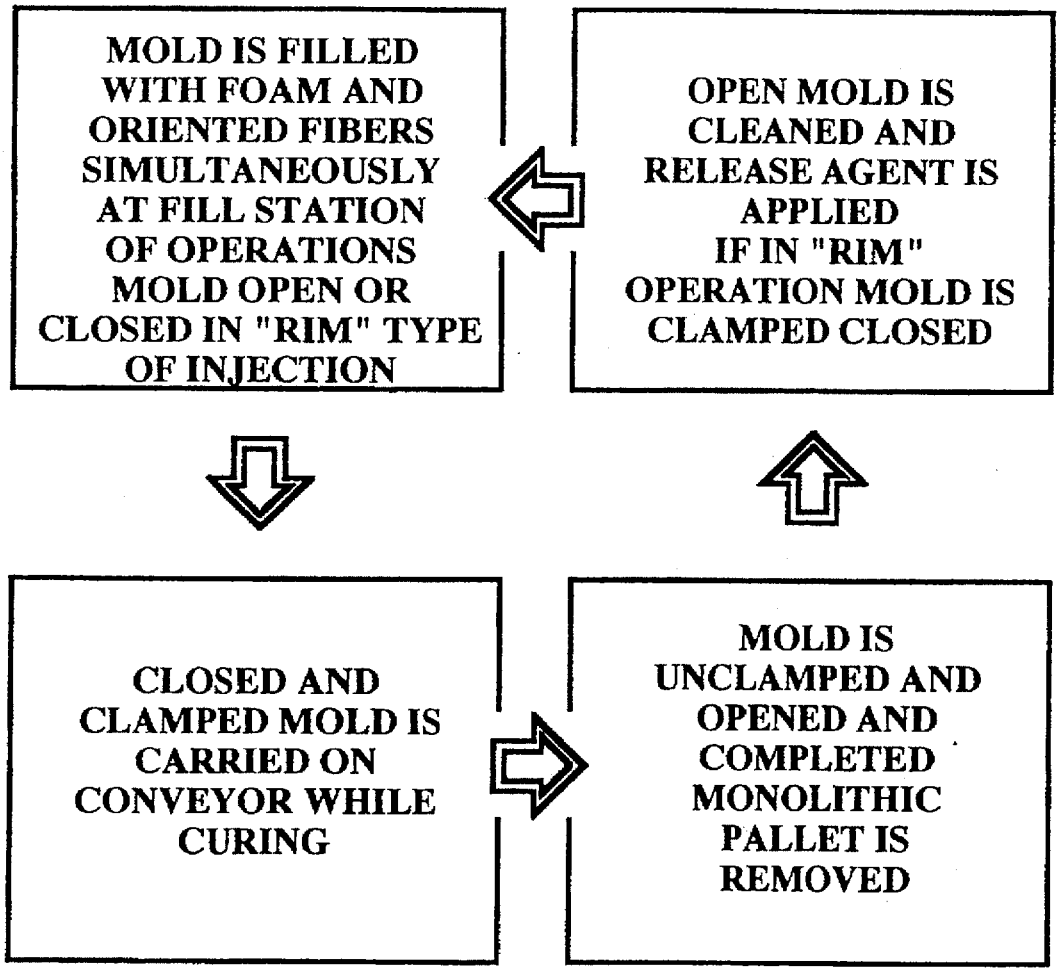
FIG. 8 is a flow chart of operations.
Figure 9:
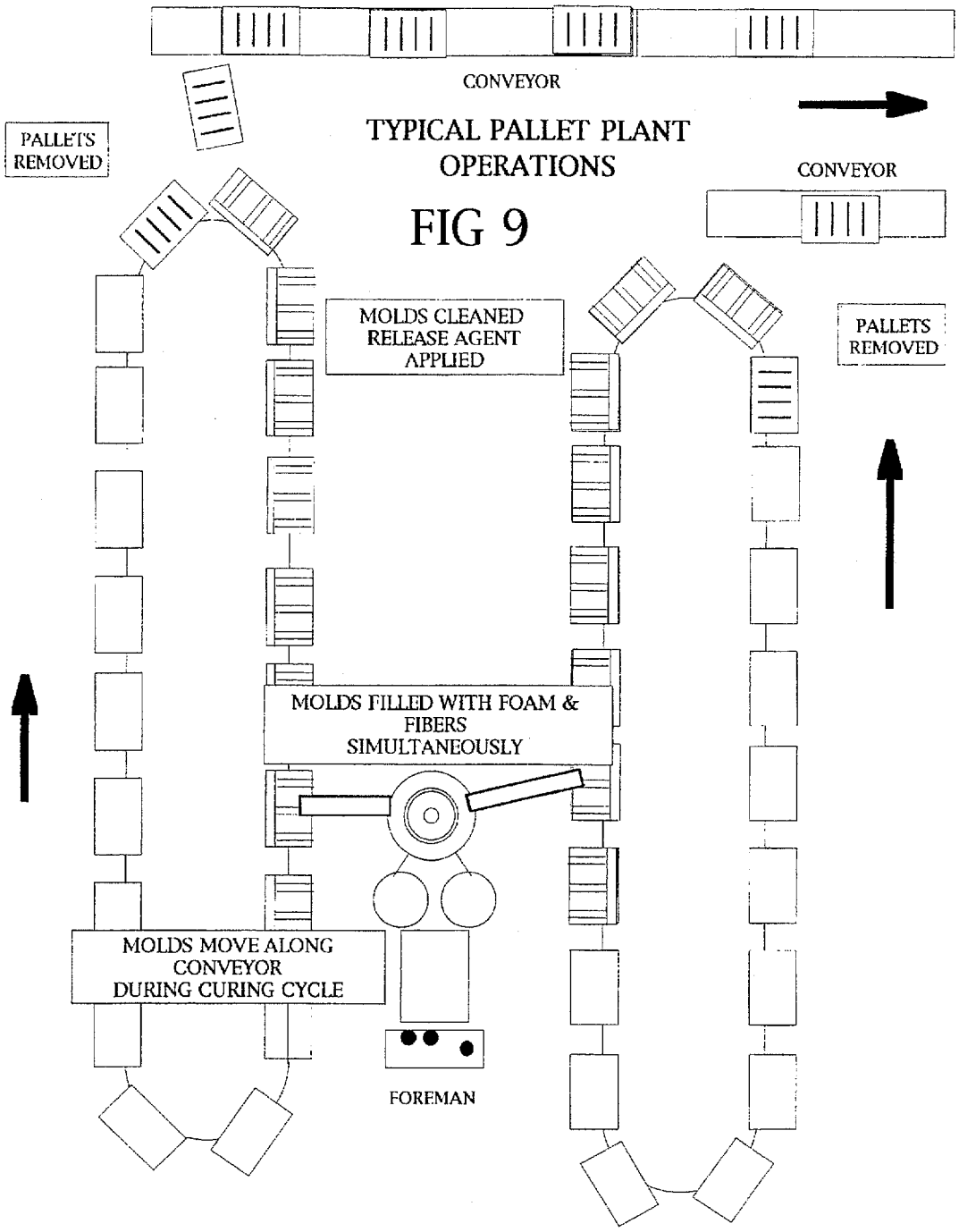
FIG. 9 is a schematic diagram of a pallet plant in operation.

The manufacturing process, which is shown as a flow chart in FIG. 8 in a schematic diagram in FIG. 9 is as follows:

1. An open mold 30, held in position on a mold carrier, is positioned at the site of injection of plastic foam ingredients and oriented strand fibers 21, simultaneously and in sufficient quantities to accomplish the requisites of density and strength. The fibers 18 are oriented by injecting them into an enclosed stream of air prior to contact with the plastic resin components 19 and 20, as shown in FIG. 5. The fibers 18 thus align themselves along their long axes by the airstream's pressure and flow.

2. The chopped fibers 18 of sufficient length to achieve maximum overlap and plastic resin 19 and 20 are combined just prior to entrance into the mold 30, and simultaneously injected from three different directions into the mold 30. The blended resin 21 injected through the first injection port 34 orients the fiber strands along the long axis of the pallet runners 13, as shown in FIG. 6. Simultaneously, the blended resin 21 is also injected through two opposing injection ports 36 and 38, oriented perpendicular to the first injection port 34. The flow of the resin 21 within the mold 30 orients the fiber strands 18 along the long axes of the top platform 11 and the bottom supports 14 of the pallet, as shown in FIG. 7. The resin impregnated fibers 18 are thus aligned with a large percentage configured in a uni-directional, but perpendicular fashion, giving maximum strength along the long axis of each component of the pallet 10.

3. The mold 30 is closed and is conveyed along the manufacturing line to cure while another mold is positioned at the injecting site.

4. At a timed interval, which allows for curing of the matrix, the mold 30 is opened and the completed monolithic pallet 10, comprising all the properties claimed, including triaxial intersecting openings, is removed.

5. Optionally, an elastomeric coating can then be applied by spraying or dipping the completely formed monolithic pallet 10. Such a coating would contain materials to increase the pallet's impact and wear resistance. Such ready-to-apply materials could also impart other desired qualities including color, fire resistance or abrasive resistance.

This invention is not to be limited by the embodiment shown in the drawings and described herein. The system has other far reaching applications in similar fields.

I claim:

1. A monolithic pallet construction, comprising:

an upper deck, a plurality of depending legs attached to said upper deck, and a plurality of bottom supports attached to said depending legs, said bottom supports, said upper deck and said plurality of depending legs being integrally formed of a rigid plastic foam, and oriented reinforcing fibers incorporated into said rigid plastic foam; within said upper deck, said oriented reinforcing fibers being oriented substantially parallel to a long axis of said upper deck; within said bottom supports, said oriented reinforcing fibers being oriented substantially parallel to a long axis of said bottom supports.

2. The pallet construction of claim 1 wherein said rigid plastic foam comprises rigid polyurethane foam.

3. The pallet construction of claim 1 wherein said plurality of depending legs is attached to said upper deck by a plurality of support runners which are attached to said upper deck and to said depending legs, wherein said plurality of bottom supports are perpendicular to said support runners, wherein said upper deck is perforated and wherein, within said support runners, said oriented reinforcing fibers are oriented substantially parallel to a long axis of said support runners.

4. A monolithic pallet construction, comprising:

an upper deck, a plurality of depending legs attached to said upper deck, and a plurality of bottom supports attached to said depending legs, said bottom supports, said upper deck and said plurality of depending legs being integrally formed of a rigid plastic foam, a nonfoamed plastic skin covering all exterior surfaces of said pallet, and oriented reinforcing fibers incorporated into said nonfoamed plastic skin; within said upper deck, said oriented reinforcing fibers being oriented substantially parallel to a long axis of said upper deck; within said bottom supports, said oriented reinforcing fibers being oriented substantially parallel to a long axis of said bottom supports.

5. The pallet construction of claim 4 further comprising oriented reinforcing fibers incorporated into said rigid plastic foam; within said upper deck, said oriented reinforcing fibers in said rigid plastic foam being oriented substantially parallel to a long axis of said upper deck; within said bottom supports, said oriented reinforcing fibers in said rigid plastic foam being oriented substantially parallel to a long axis of said bottom supports and wherein said nonfoamed plastic skin is formed of the same plastic material as said rigid plastic foam.

6. The pallet construction of claim 5 wherein said rigid plastic foam comprises a rigid polyurethane foam and said nonfoamed plastic skin comprises a rigid polyurethane.

7. The pallet construction of claim 5 wherein said plurality of depending legs is attached to said upper deck by a plurality of support runners which are attached to said upper deck and to said depending legs, wherein said plurality of bottom support are perpendicular to said support runners, wherein said upper deck is perforated and wherein, within said support runners, said oriented reinforcing fibers in said rigid plastic foam are oriented substantially parallel to a long axis of said support runners.

8. The pallet construction of claim 4 wherein said plurality of depending legs is attached to said upper deck by a plurality of support runners which are attached to said upper deck and to said depending legs, wherein said plurality of bottom supports are perpendicular to said support runners, wherein said upper deck is perforated and wherein, within said support runners, said oriented reinforcing fibers are oriented substantially parallel to a long axis of said support runners.

9. A monolithic pallet construction, comprising:

an upper deck formed by injecting plastic foam containing fiber strands into a mold along a long axis of said upper deck such that said fiber strands are oriented substantially parallel to said long axis of said upper deck, a plurality of support runners attached to said upper deck, said plurality of support runners formed by injecting plastic foam containing fiber strands into said mold along a long axis of said plurality of support runners such that said fiber strands are oriented substantially parallel to said long axis of said plurality of support runners, and a plurality of bottom supports attached to said plurality of support runners, said plurality of bottom supports having a long axis perpendicular to said long axis of said support runners, said plurality of bottom supports formed by injecting plastic foam containing fiber strands into said mold along said long axis of said plurality of bottom supports such that said fiber strands are oriented substantially parallel to said long axis of said plurality of bottom supports.

10. The pallet construction of claim 9 further comprising a nonfoamed plastic skin covering all exterior surfaces of said pallet, wherein said nonfoamed plastic skin is formed integrally of the same plastic material as said plastic foam by coalescing said plastic material from said plastic foam onto an inner surface of said mold to form said nonfoamed plastic skin.

11. The pallet construction of claim 10 further comprising oriented fiber strands incorporated into said nonfoamed plastic skin; within said upper deck, said oriented fiber strands being oriented substantially parallel to said long axis of said upper deck; within said support runners, said oriented fiber strands being oriented substantially parallel to said long axis of said support runners; within said bottom supports, said oriented fiber strands being oriented substantially parallel to said long axis of said bottom supports.

12. The pallet construction of claim 9, wherein said upper deck, said plurality of support runners and said plurality of bottom supports are formed simultaneously by simultaneously injecting plastic foam containing fiber strands into said mold along said long axis of said upper deck, said long axis of said plurality of support runners and said long axis of said plurality of bottom supports.

13. The pallet construction of claim 12, wherein, prior to injecting said plastic foam containing fiber strands into said mold, said fiber strands are incorporated into said plastic foam by introducing said fiber strands into a moving airstream to orient said fiber strands longitudinally with respect to said moving airstream, then mixing the oriented fiber strands into said plastic foam.

14. The pallet construction of claim 13, wherein said oriented fiber strands are mixed into said plastic foam simultaneously with forming said plastic foam by mixing at least two components by impingement of said at least two components into one another.

15. A method of manufacturing a pallet, comprising the steps of:

forming an upper deck by injecting plastic foam containing fiber strands into a mold along a long axis of said upper deck such that said fiber strands are oriented substantially parallel to said long axis of said upper deck;

forming a plurality of support runners attached to said upper deck by injecting plastic foam containing-fiber strands into said mold along a long axis of said plurality of support runners such that said fiber strands are oriented substantially parallel to said long axis of said plurality of support runners; and forming a plurality of bottom supports attached to said plurality of support runners, said plurality of bottom supports having a long axis perpendicular to said long axis of said support runners, by injecting plastic foam containing fiber strands into said mold along said long axis of said plurality of bottom supports such that said fiber strands are oriented substantially parallel to said long axis of said plurality of bottom supports.

16. The method of claim 15 further comprising: forming a nonfoamed plastic skin covering all exterior surfaces of said pallet, wherein said nonfoamed plastic skin is formed integrally of the same plastic material as said plastic foam, by coalescing said plastic material from said plastic foam onto an inner surface of said mold to form said nonfoamed plastic skin.

17. The method of claim 15, wherein said upper deck, said plurality of support runners and said plurality of bottom supports are formed simultaneously by simultaneously injecting plastic foam containing fiber strands into said mold along said long axis of said upper deck, said long axis of said plurality of support runners and said long axis of said plurality of bottom supports.

18. The method of claim 17, wherein, prior to injecting said plastic foam containing fiber strands into said mold, said fiber strands are incorporated into said plastic foam by introducing said fiber strands into a moving airstream to orient said fiber strands longitudinally with respect to said moving airstream, then mixing the oriented fiber strands into said plastic foam.

19. The method of claim 18, wherein said oriented fiber strands are mixed into said plastic foam simultaneously with forming said plastic foam by mixing at least two components by impingement of said at least two components into one another.

20. The pallet construction of claim 9, wherein said fiber strands comprise chopped fiber strands with a length of approximately 0.10–1.00 inches.

21. The pallet construction of claim 20, wherein said chopped fiber strands are chosen from the group consisting of fiberglass, Kevlar fibers, carbon fibers, polyester fibers, cellulose fibers, ceramic fibers, and metal fibers.

22. The pallet construction of claim 9, wherein said fiber strands comprise short fiber strands with a length of approximately 0.10–0.25 inches.

23. The pallet construction of claim 9, wherein said fiber strands comprise long fiber strands with a length of approximately 0.75–1.00 inches.

24. The pallet construction of claim 9, wherein said plastic foam comprises rigid polyurethane foam.

25. The method of claim 15, wherein, prior to injecting said plastic foam containing fiber strands into said mold, said fiber strands are incorporated into said plastic foam as chopped fiber strands with a length of approximately 0.10–1.00 inches.

26. The method of claim 25, wherein said chopped fiber strands are chosen from the group consisting of fiberglass, Kevlar fibers, carbon fibers, polyester fibers, cellulose fibers, ceramic fibers, and metal fibers.

27. The method of claim 15, wherein, prior to injecting said plastic foam containing fiber strands into said mold, said fiber strands are incorporated into said plastic foam as short fiber strands with a length of approximately 0.10–6.25 inches.

28. The method of claim 15, wherein, prior to injecting said plastic foam containing fiber strands into said mold, said fiber strands are incorporated into said plastic foam as long fiber strands with a length of approximately 0.75–1.00 inches.

29. The method of claim 15, wherein said plastic foam comprises rigid-polyurethane foam.

30. The method of claim 15, wherein said upper deck, said plurality of support runners and said plurality of bottom supports are formed by injecting said plastic foam containing fiber strands into a clam-shell mold having removable cores for maintaining open spaces between said upper deck, said plurality of support runners and said plurality of bottom supports, and subsequently removing said clam-shell mold and removable cores from the molded pallet.

* * * * *